US011898561B2

(12) United States Patent
Qiu et al.

(10) Patent No.: US 11,898,561 B2
(45) Date of Patent: Feb. 13, 2024

(54) DIRECT DRIVE REFRIGERANT SCREW COMPRESSOR WITH REFRIGERANT LUBRICATED ROTORS

(71) Applicant: Carrier Corporation, Palm Beach Gardens, FL (US)

(72) Inventors: Yifan Qiu, Manlius, NY (US); Amit Vaidya, Jamesville, NY (US); Ulf J. Jonsson, South Windsor, CT (US); Zaffir A. Chaudhry, South Glastonbury, CT (US); David M. Rockwell, Cicero, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/973,724

(22) PCT Filed: May 19, 2020

(86) PCT No.: PCT/US2020/033585
§ 371 (c)(1),
(2) Date: Dec. 9, 2020

(87) PCT Pub. No.: WO2020/236809
PCT Pub. Date: Nov. 26, 2020

(65) Prior Publication Data

US 2022/0065252 A1 Mar. 3, 2022

Related U.S. Application Data

(60) Provisional application No. 62/850,296, filed on May 20, 2019.

(51) Int. Cl.

| | |
|---|---|
| ***F04C 29/02*** | (2006.01) |
| ***F04C 18/16*** | (2006.01) |
| ***F25B 1/047*** | (2006.01) |

(52) U.S. Cl.
CPC ..... *F04C 29/02* (2013.01); *F04C 18/16* (2013.01); *F04C 29/023* (2013.01);
(Continued)

(58) Field of Classification Search
CPC ..... F04C 29/02; F04C 18/16; F04C 29/028; F04C 29/026; F04C 2210/10;
(Continued)

(56) References Cited

U.S. PATENT DOCUMENTS 3,557,687 A * 1/1971 Grinpress ..... F04C 29/023 418/94
3,921,718 A 11/1975 Tate
(Continued)

FOREIGN PATENT DOCUMENTS

CN 207018201 U 2/2018
CN 108757450 A * 11/2018 ..... F04C 18/16
(Continued)

OTHER PUBLICATIONS

English Machine Translation of CN108757450A translated by the USPTO Fit database on Sep. 4, 2023 (Year: 2018).*
ISR/WO; PCT/US2020/033585; mailed Aug. 24, 2020; 23 pages.

*Primary Examiner* — Dominick L Plakkoottam
*Assistant Examiner* — Paul W Thiede
(74) *Attorney, Agent, or Firm* — CANTOR COLBURN LLP

(57) ABSTRACT

Disclosed is a direct-drive refrigerant screw compressor, having: a housing; a compression chamber in the housing; a pair of rotors, each rotor of the pair of rotors being rotationally disposed in the compression chamber and including an outer surface with a screw-geared profile; a fluid being disposed in the compression chamber, the fluid consisting of a working fluid for providing lubrication to each rotor; a first port extending through the housing and configured for
(Continued)

directing the fluid toward the compression chamber; and when the compressor is activated, each rotor rotates and the fluid is distributed about each rotor to lubricate each rotor.

6 Claims, 9 Drawing Sheets

(52) U.S. Cl.
CPC ..... *F04C 29/028* (2013.01); *F04C 29/026* (2013.01); *F04C 2210/10* (2013.01); *F04C 2210/14* (2013.01); *F04C 2240/20* (2013.01); *F04C 2240/50* (2013.01); *F25B 1/047* (2013.01)

(58) Field of Classification Search
CPC ..... F04C 2210/14; F04C 2240/20; F04C 2240/50; F04C 29/023; F25B 1/047
See application file for complete search history.

(56) References Cited

U.S. PATENT DOCUMENTS

| | | | | |
|---|---|---|---|---|
| 4,478,054 | A * | 10/1984 | Shaw | F25B 1/047 418/98 |
| 5,027,606 | A | 7/1991 | Short | |
| 5,653,585 | A * | 8/1997 | Fresco | F25B 1/047 418/94 |
| 7,614,862 | B2 | 11/2009 | Van Der Heggen et al. | |
| 8,104,298 | B2 | 1/2012 | Sishtla | |
| 9,494,154 | B2 | 11/2016 | Fujisawa et al. | |
| 9,732,751 | B2 | 8/2017 | Takeda et al. | |
| 2013/0052072 | A1 | 2/2013 | Smith et al. | |
| 2016/0054040 | A1 | 2/2016 | Jonsson et al. | |
| 2017/0082108 | A1 | 3/2017 | Tsaimin et al. | |
| 2017/0097007 | A1 | 4/2017 | Sishtla | |
| 2018/0128520 | A1 | 5/2018 | Lapp et al. | |
| 2018/0180333 | A1 | 6/2018 | Sishtla et al. | |
| 2019/0032663 | A1 | 1/2019 | Tsai et al. | |
| 2022/0074415 | A1* | 3/2022 | Qiu | F04C 29/0007 |

FOREIGN PATENT DOCUMENTS

| | | | | |
|---|---|---|---|---|
| CN | 108757450 | A | 11/2018 | |
| EP | 1400765 | A2 | 3/2004 | |
| EP | 1851435 | A1 | 11/2007 | |
| EP | 3135863 | A1 | 3/2017 | |
| EP | 2549107 | B1 | 11/2017 | |
| EP | 3120022 | B1 | 2/2018 | |
| EP | 3438459 | A1 | 2/2019 | |
| WO | WO-2009121151 | A1 * | 10/2009 | F04C 18/16 |
| WO | 2017024101 | A1 | 2/2017 | |
| WO | 2018038918 | A1 | 3/2018 | |

* cited by examiner

DIRECT DRIVE REFRIGERANT SCREW COMPRESSOR WITH REFRIGERANT LUBRICATED ROTORS

CROSS REFERENCE TO RELATED APPLICATIONS

This application is a US National Stage of Application No. PT/US20033585, filed May 19, 2020, which claims the benefit of U.S. application Ser. No. 62/850,296, filed on May 20, 2019, both of which are incorporated herein by reference in their entirety.

BACKGROUND

The disclosure relates generally to compressor systems and, more specifically, to a direct drive refrigerant screw compressor using refrigerant lubrication of one or more components thereof.

Refrigeration systems are utilized in many applications to condition an environment. The cooling or heating load of the environment may vary with ambient conditions, occupancy level, other changes in sensible and latent load demands, and with temperature and/or humidity changes.

Refrigeration systems typically include a compressor to deliver compressed refrigerant to a condenser. From the condenser, the refrigerant travels to an expansion valve and then to an evaporator. From the evaporator, the refrigerant returns to the compressor to be compressed.

A direct drive screw compressor in an HVAC chiller application has a driving (male) rotor and a driven (female) rotor. An electric motor drives the driving rotor to rotate. The driving rotor then drives the driven rotor by way of meshing. The meshing process requires direct contact of the rotors at contact locations. Lubrication is necessary to protect both rotors and decrease the friction during operation.

In addition, the rotors in a screw compressor in HVAC chiller applications are supported by rolling element bearings. These bearings may be lubricated using oil because of a high viscosity requirement of bearing lubricant. After passing through the bearings, oil is mixed with refrigerant in the compression process to be carried out of the compressor.

BRIEF DESCRIPTION

Disclosed is a direct-drive refrigerant screw compressor, comprising: a housing; a compression chamber in the housing; a pair of rotors, each rotor of the pair of rotors being rotationally disposed in the compression chamber and including an outer surface with a screw-geared profile; a fluid being disposed in the compression chamber, the fluid consisting of a working fluid for providing lubrication to each rotor; a first port extending through the housing and configured for directing the fluid toward the compression chamber; and when the compressor is activated, each rotor rotates and the fluid is distributed about each rotor to lubricate each rotor.

In addition to one or more of the above features, or as an alternate, the first port includes a flow control orifice.

In addition to one or more of the above features, or as an alternate, the first port extends directly into the compression chamber.

In addition to one or more of the above features, or as an alternate, the first port is fluidly connected to a passage in one rotor of the pair of rotors that directs the fluid to the compression chamber.

In addition to one or more of the above features, or as an alternate, the passage extends between an axial aft port in the one rotor and the outer surface of the one rotor.

In addition to one or more of the above features, or as an alternate, the passage includes an axial segment forming a blind hole and a radial segment fluidly connected between the axial segment and a surface port on the outer surface of the one rotor.

In addition to one or more of the above features, or as an alternate, the passage includes a plurality of the radial segments fluidly connected to a respective plurality of the surface ports on the outer surface of the one rotor.

In addition to one or more of the above features, or as an alternate, the plurality of the surface ports are staggered at regular intervals along the outer surface of the one rotor.

In addition to one or more of the above features, or as an alternate, the plurality of the radial segments each include opposing radial portions extending to a respective plurality of the surface ports on the outer surface of the one rotor.

Further disclosed is a refrigerant system including: a condenser; a compressor having one or more of the above disclosed features; and a conduit fluidly connecting the condenser and the first port of the compressor, and configured to transport the fluid to the compressor to provide the working fluid to each rotor.

Further disclosed is a method of directing fluid in a direct drive screw compressor, comprising: receiving fluid at a first port of a housing of the compressor, wherein the fluid consists of a working fluid for providing lubrication to each rotor of a pair of rotors in the compressor; and directing the fluid from the first port to a compression chamber in the compressor; and when the compressor is activated, each rotor rotates and the fluid is distributed about each rotor to lubricate each rotor.

In addition to one or more of the above features, or as an alternate, the method includes controlling flow through the first port with a flow control orifice.

In addition to one or more of the above features, or as an alternate, directing the fluid to the compression chamber includes: injecting the fluid from the first port directly into the compression chamber.

In addition to one or more of the above features, or as an alternate, directing the fluid to the compression chamber includes: injecting the fluid from the first port, through a passage in one rotor of the pair of rotors, whereby the fluid is injected into the compression chamber.

In addition to one or more of the above features, or as an alternate, injecting the fluid through the passage includes: directing the fluid from the first port into an axial aft port in the passage and out an outer surface of the one rotor.

In addition to one or more of the above features, or as an alternate, directing the fluid through the passage further includes: directing the fluid through an axial segment forming a blind hole in the one rotor and a radial segment fluidly connected between the axial segment and a first surface port on the outer surface of the one rotor.

In addition to one or more of the above features, or as an alternate, directing the fluid through the passage further includes: directing the fluid though a plurality of the radial segments fluidly connected to a respective plurality of the surface ports on the outer surface of the one rotor.

In addition to one or more of the above features, or as an alternate, directing the fluid through the passage further includes: directing the fluid through opposing radial portions of each of the plurality of the radial segments, the opposing radial portions extending to a respective plurality of the surface ports on the outer surface of the one rotor.

In addition to one or more of the above features, or as an alternate, receiving the fluid at the first port from a condenser in a refrigerant system in which the compressor is integrated, to provide the working fluid to each rotor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
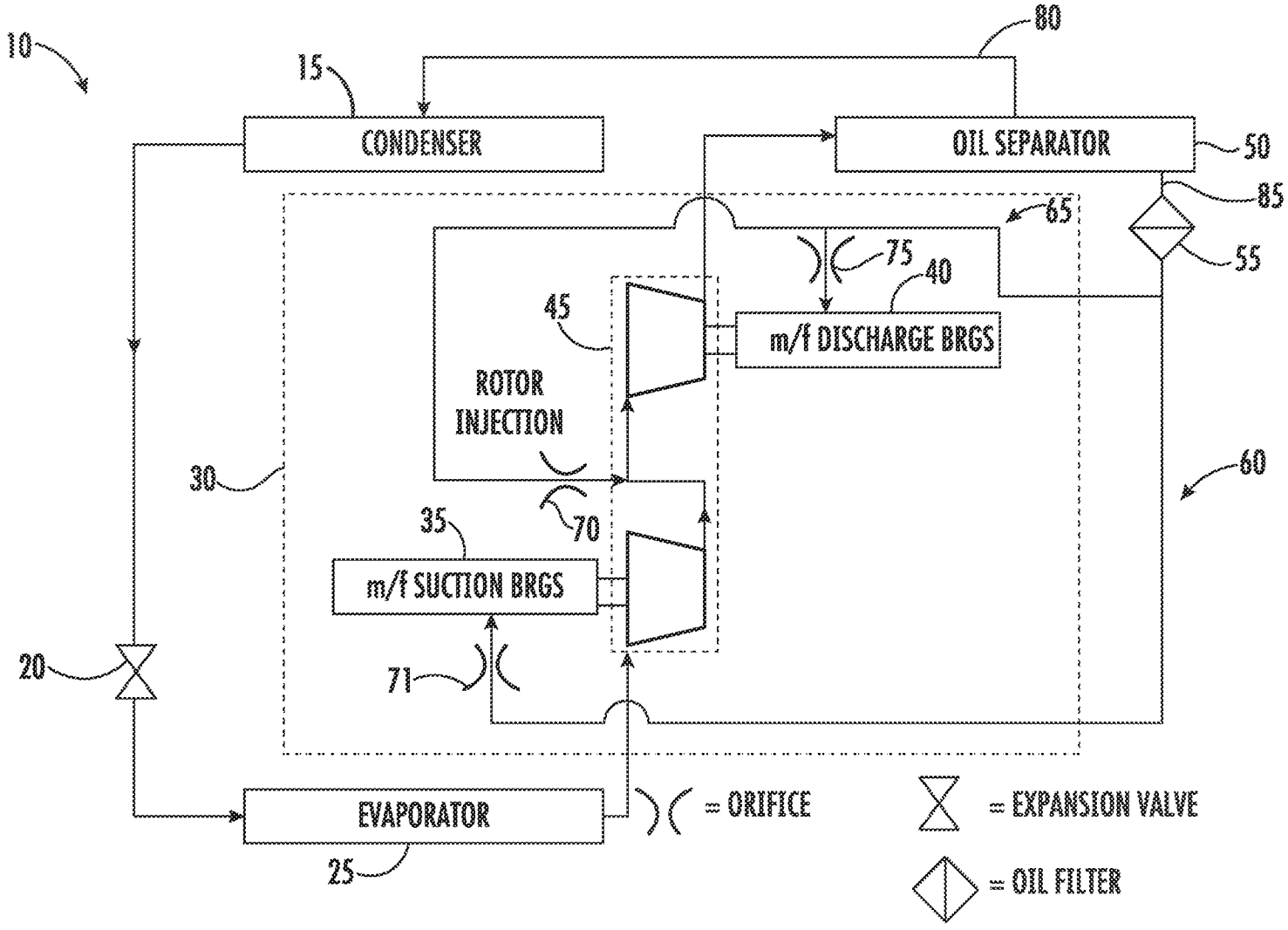
FIG. 1 is a refrigerant system in which features of the disclosed embodiments may be utilized.

Described herein are systems and methods for lubricating components of a compressor in a refrigeration system. FIG. 1 illustrates a refrigeration system 10 that is an oil lubricated system. The system 10 includes a condenser 15 that receives a high pressure gaseous form of the working fluid, ejects heat from the working fluid, for example to the environment, and outputs a high pressure liquid form of the working fluid. Downstream of the condenser 15 is an expansion valve 20 that receives the high pressure liquid form of the working fluid and outputs a low pressure liquid form of the working fluid. Downstream of the expansion valve 20 is an evaporator 25 that receives the low pressure liquid form of the working fluid, transfers heat to the working fluid, thereby conditioning warm air, and outputs a low pressure gaseous form of the working fluid. Downstream of the evaporator 25 is a compressor 30 that receives the low pressure gaseous form of the working fluid and outputs a high pressure gaseous form of the working fluid.

The compressor 30 may be a screw compressor that includes suction bearings 35, discharge bearings 40, and a set of rotors 45 therebetween. Both sets of bearings 35, 40 and the rotors 45 require some form of lubrication. Lubricating oil is provided by an oil separator 50. The oil separator 50 transfers oil to an oil filter 55. The oil filter 55 transfers oil a first portion of oil 60 to one orifice 71, e.g. in the compressor housing, fluidly connected to the suction bearings 35. A second portion of oil 65 is distributed in parallel to one orifice 70, e.g., in the compressor housing, fluidly connected to the rotors 45 and another orifice 75, e.g., in the compressor housing, fluidly connected to the discharged bearings 40. The oil then mixes with the working fluid in the compressor 30.

Output from the compressor 30 is directed to the oil separator 50. The oil separator 50 separates the output from the compressor into a first portion 80 that is the working fluid directed the condenser 15. The second portion 85 is the lubricant directed to the filter 55. Unless otherwise indicated herein, for each embodiment all flows between the system components that are separately referred to are fluidly transferred in respective conduit lines. It is to be appreciated that fluid branches that are branched upstream or downstream of the orifices 70, 75 in the housing of the compressor 30 may be branched in conduit exterior to the housing of the compressor 30.

Viscosity of oil lubricant may be reduced when mixed with the working fluid. Both bearing load carrying capacity and oil sealing characteristics are dependent upon the oil viscosity. As such, due to lower viscosity, moving components, such as bearings and rotors, in some systems may experience increased wear during operation. In addition, separating lubricating oil from refrigerant requires the use and maintenance of additional equipment such as the oil separator and related filter. In addition, because the oil separation process cannot completely remove the oil from refrigerant, excessive oil may decrease heat transfer efficiency in the system and lower the overall system capacity. Oil may be saturated with refrigerant in the separator. The separation process is often unable to adequately lower the refrigerant content in the oil.

In view of the above challenges FIGS. 2-7 disclose embodiments in which an oil separator and oil filter may be avoided. More specifically, turning to FIG. 2, disclosed is a refrigerant system 100 (a chiller) applicable to each of the embodiments disclosed herein. The system 100 includes a condenser 110, an expansion valve 112, an evaporator 114, and a dual rotor refrigerant screw compressor 115 (compressor 115), which is a direct drive compressor. The compressor 115 includes two screw rotors 150. The rotors 150 are configured in the compressor 115 with a suction side 140*a* and discharge side 140*b* (illustrated schematically in FIG. 2). The compressor 115 includes bearing packs 190 including a suction side bearing pack 190*a* and a discharge side bearing pack 190*b*. The suction side bearing pack 190*a* may be referred to herein as a forward bearing pack and the discharge side bearing pack 190*b* may be referred to herein as an aft bearing pack.

The condenser feeds first portion 116 of a working fluid to the expansion valve 112 and, in parallel, a second portion of the working fluid 120 to the compressor 115. The working fluid consists of refrigerant form a condenser conduit 125 to the compressor 115 for providing lubrication to components of the compressor 115 as described below.

The second portion 120 of the working fluid is distributed in parallel to a first branch 121 and a second branch 122. The first branch 121 is distributed in parallel to a third branch 123 and a fourth branch 124. The third branch 123 delivers the working fluid through one or more orifices 126, e.g. in the compressor housing 130, to the suction side bearing pack 190*a*. The fourth branch 124 delivers the working fluid through another one or more orifices 127, e.g. in the compressor housing 130, to the rotors 150. The second branch 122 delivers the working fluid to a further one or more orifices 128, e.g. in the compressor housing 130, to the discharge side bearing pack 190*b*.

From the suction side bearing pack 190*a*, the working fluid flows directly into the rotors 150 with the working fluid from the evaporator 114. This may occur within the compressor housing 130. From the discharge side bearing pack 190*b* the working fluid flows to the evaporator 114 to mix with fluid therein and then be redirected to the rotors 150 of the compressor 115. This may occur by the working fluid exiting the compressor housing 130 from the discharged side bearings 190*b* and being directed thereafter to the evaporator 114. Unless otherwise indicated herein, for each embodiment all flows between the system components that are separately referred to are fluidly transferred in respective conduit lines. It is to be appreciated that fluid branches that are branched upstream or downstream of the orifices 126, 127, 128 in the compressor housing 130 may be branched in conduit exterior to the compressor housing 130.

Figure 3:
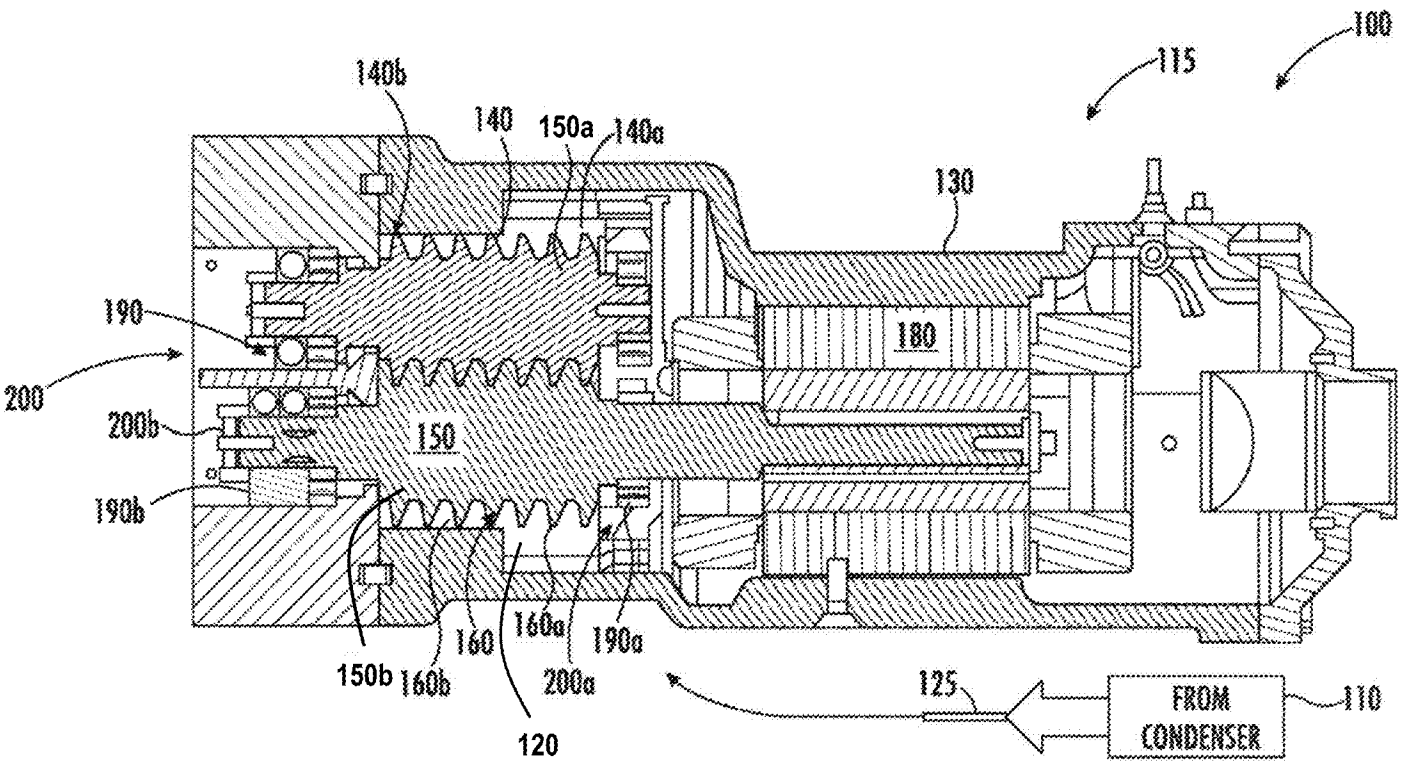
FIG. 3 is a direct-drive screw compressor according to one embodiment.
Figure 4:
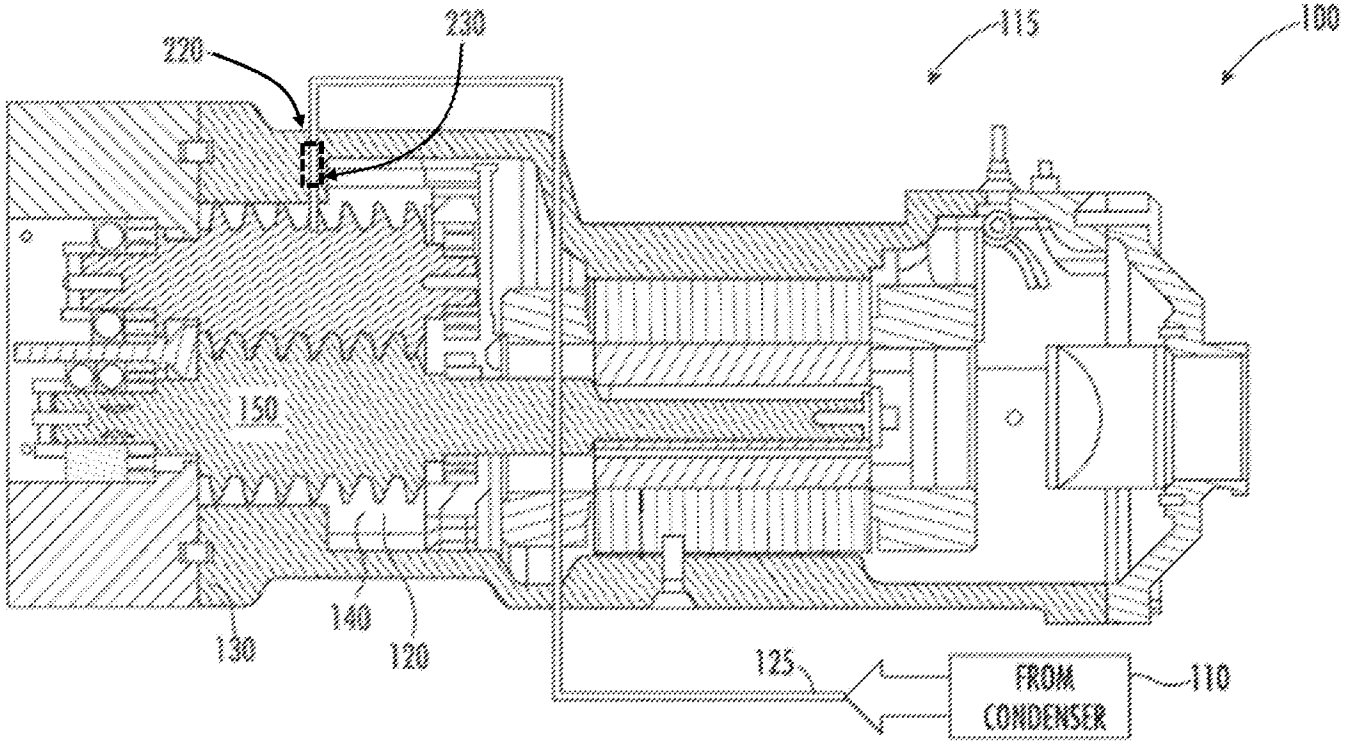
FIG. 4 is a direct-drive screw compressor according to one embodiment.
Figure 5:
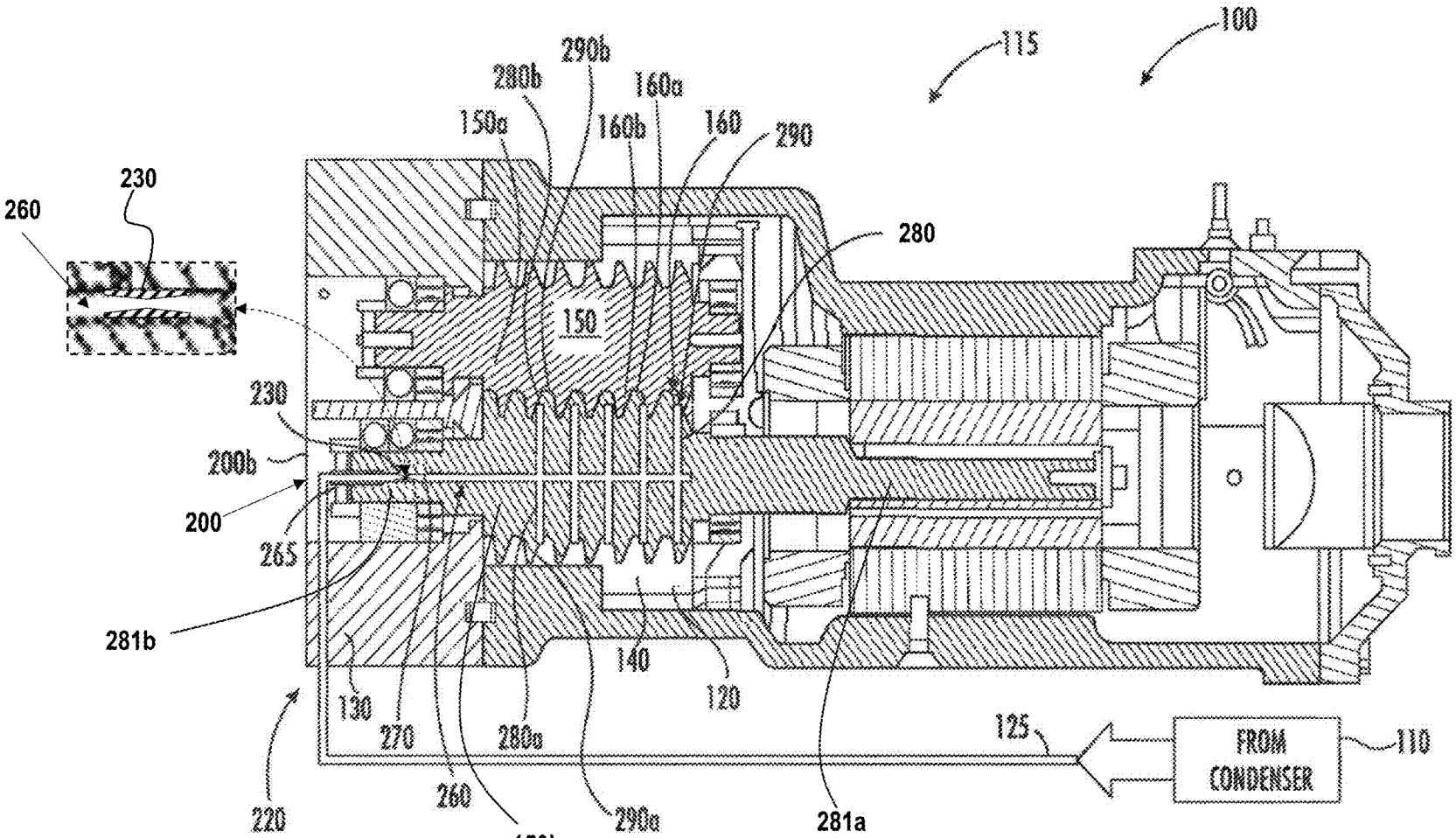
FIG. 5 is a direct-drive screw compressor according to one embodiment.
Figure 6:
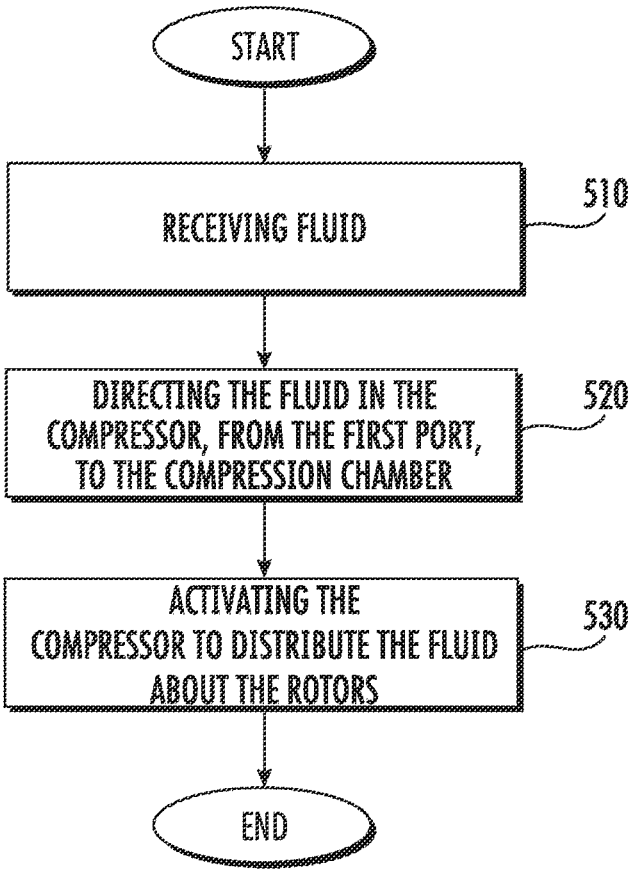
FIG. 6 is a method of transporting refrigerant as a lubricant with the compressor of FIG. 4.

The features of the compressor are illustrated more specifically, for example, in FIGS. 3-5. Turning now to FIG. 3, the compressor 115 includes the housing 130. A compression chamber 140 is disposed in the housing 130. The compression chamber 140 has a forward end 140*a* and an aft end 140*b* which are respective suction and discharge sides of the compression chamber 140. For simplicity, inlet and outlet ports in the housing 130 for fluidly communicating working fluid 120 in the refrigeration system 100 are not illustrated in FIG. 3.

The compressor 115 includes the plurality of rotors generally referred to as 150, including the first rotor 150*a* and the second rotor 150*b*, rotationally disposed in the compression chamber 140. Each rotor 150 includes an outer surface 160 with a screw-geared profile, for example, having an alternating plurality of peaks 160*a* and plurality of troughs 160*b*, for example, in cross sectional view. The plurality of rotors 150 intermesh and form compression volumes within the compression chamber 140.

The first rotor 150*a* is a driven rotor and the second rotor 150*b* is a drive rotor, driven by a motor 180. The second rotor 150*b* includes both a first axial shaft portion 281*a* that extends to motor 180 and an opposing second axial shaft portion 281*b* that is supported by the bearings and also includes flow control orifice 230 as best seen in FIG. 5.

For each rotor 150, the compressor 115 includes the plurality of bearing packs generally referred to as 190 including the forward bearing pack generally referred to as 190*a* and the aft bearing pack generally referred to as 190*b*. For each rotor 150, the plurality of bearing packs 190 may disposed within a respective plurality of bearing chambers generally referred to as 200. The bearing chambers 200 may be structural portions of the housing 130 in or proximate the compression chamber 140 configured to securely position the respective bearing packs 190. The bearing chambers 200 may including a forward bearing chamber generally referred to as 200*a* and an aft bearing chamber generally referred to as 200*b*. The bearing chambers 200 may be fluidly connected with each other through the compression chamber 140.

Turning now to FIG. 4, an embodiment of the refrigeration system 100 is illustrated. The embodiment of FIG. 4 includes all of the features illustrated in the system 100 illustrated in FIG. 3. In FIG. 4, the fluid 120 is disposed within the compression chamber 140. A first port 220 extends through the housing 130 for directing fluid toward the compression chamber 140. The first port 220 is connected by the condenser conduit 125 to the condenser 110. According to an embodiment, the first port 220 includes a flow control orifice 230. This may be used to reduce a flow volume or rate from the condenser 110 as may be needed.

In FIG. 4, the first port 220 extends directly into the compression chamber 140. Within the compression chamber 140, the first port 220 delivers working fluid 120 between the two rotors 150 so that the working fluid 120 flows to meshing points between the two rotors 150. In one embodiment, the first port 220 is proximate one rotor 150 (the second rotor 150*b*) of the compressor 115 and distal the other rotor 150 (the first rotor 150*a*). Identifying the one rotor 150 as the second rotor 150*b* and the other rotor 150 as the first rotor 150*a* in the embodiment in FIG. 4 is for example only and not intended on limiting the scope of the embodiments. Rotation of the rotors 150 distributes the fluid 120 about the rotors 150.

Turning now to FIG. 5, an embodiment of the refrigeration system 100 is illustrated. The embodiment of FIG. 5 includes all of the features illustrated in the system 100 illustrated in FIG. 3. In FIG. 5, the fluid 120 is disposed within the compression chamber 140. A first port 220, configured differently than the first port 220 in the embodiment of FIG. 4, extends through the housing 130. In FIG. 5, the first port 220 fluidly connects with a passage 260 within one rotor 150 (the first rotor 150*a*) for directing fluid toward the compression chamber 140. Identifying the one rotor 150 as the first rotor 150*a*, and thus the other rotor 150 as the second rotor 150*b*, in the embodiment in FIG. 5 is for example only and not intended on limiting the scope of the embodiments. The first port 220 is connected by the condenser conduit 125 to the condenser 110. According to an embodiment, the passage 260 includes a flow control orifice 230, which may be the same as the above introduced flow control orifice 230. This may be used to reduce a flow volume or rate from the condenser 110 as may be needed.

The passage 260 may be an internal passage in the one rotor 150. The passage 260 may be fluidly connected between an axial aft port 265 in the one rotor 150 and the outer surface 160 of the one rotor 150. The aft port 265 may be in the respective aft bearing chamber 200*b*, though this placement is not intended to be limiting.

The passage 260 may include an axial segment 270 forming a blind hole in the one rotor 150 and a radial segment generally referred to as 280 fluidly connected between the axial segment 270 and a surface port generally referred to as 290 on the outer surface 160 of the one rotor 150. In one embodiment, the passage 260 may include a plurality of the radial segments 280 fluidly connected to a respective plurality of the surface ports 290 on the outer surface 160 of the one rotor 150. This configuration may provide a greater distribution of the fluid 120 about each rotor 150 as compared with, for example, a single fluid 120 port.

In one embodiment, the plurality of the surface ports 290 may be staggered at regular intervals along the outer surface 160, for example, at or proximate the plurality of alternating peaks 160*a* or troughs 160*b*. This configuration may provide an even distribution of fluid 120 around the outer surface 160 of the each rotor 150. In one embodiment the plurality of the radial segments 280 may each include a plurality of opposing radial portions 280*a*, 280*b* extending to a respective plurality of the radial ports 290*a*, 290*b* on the outer surface 160 of the one rotor 150. This configuration may provide an ability to quickly distribute fluid 120 around the outer surface 160 of the rotors 150.

Turning to FIG. 5, a method is disclosed of directing fluid 120 in the compressor 115 for the embodiment illustrated in FIG. 3. The method includes block 510 of receiving the fluid 120 at the first port 220 of the housing 130. In an embodiment, block 510 further includes controlling flow in the first port 220 through a flow control orifice 230 (which may be the same as orifice 127 in FIG. 2). The method further includes block 520 of directing the fluid 120 in the compressor 115, from the first port 220, to the compression chamber 140. According to an embodiment, block 520 further includes injecting the fluid 120 from the first port 220 directly into the compression chamber 140 proximate one rotor 150 and distal the other rotor 150. At block 530 the compressor is activated to distribute the fluid about the rotors 150.

Figure 7:
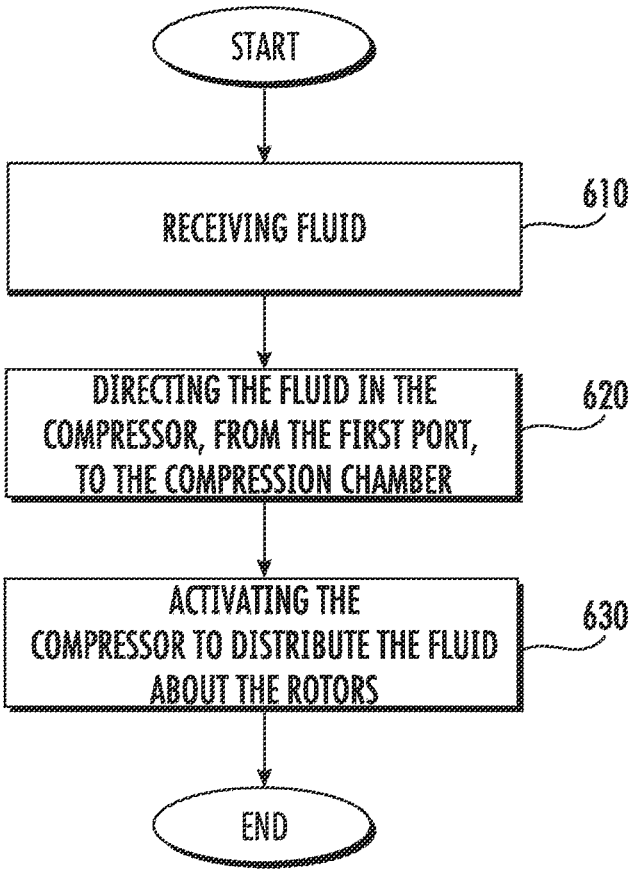
FIG. 7 is a method of transporting refrigerant as a lubricant with the compressor of FIG. 5.

Turning to FIG. 7, a method is disclosed of directing fluid 120 in the compressor 115 for the embodiment illustrated in FIG. 5. Similar to the method in FIG. 6, the method of FIG. 7 includes block 610 of receiving the fluid 120 at the first port 220 of the housing 130. The method of FIG. 7 includes block 620 of directing the fluid 120, from the first port 220, to the compression chamber 140. In an embodiment, block 620 further includes controlling flow in the passage 260 through a flow control orifice 230. In an embodiment, block 620 further includes injecting the fluid 120 through the first port 220, through a passage 260 in one rotor 150, and into the compression chamber 140. Then, at block 630 the compressor is activated to distribute the fluid about the rotors 150.

Thus, in the above disclosed embodiments, the working fluid 120 is drawn from a chiller condenser and used to provide lubrication to the compressor and more specifically to the screw rotors. The liquid can be injected direct from port(s) on the housing close to the rotor meshing locations or through a passage inside the driving rotor. The liquid flow can be adjusted by using flow restriction devices, such as a flow control orifice. The embodiments enable the utilization of pure refrigerant as the working fluid 120 in the components of the system 100, including the condenser 110, evaporator 114, etc.

Figure 8:
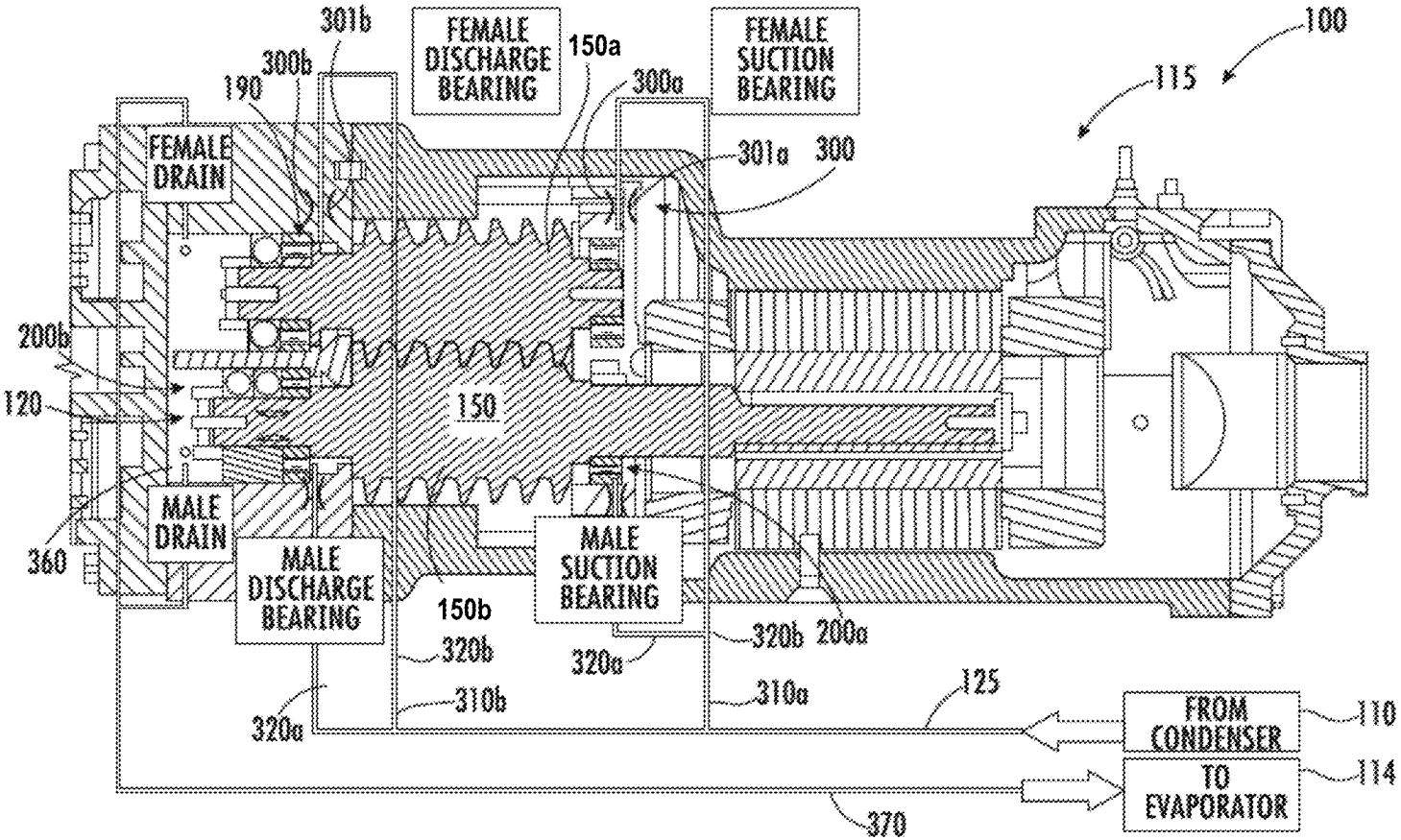
FIG. 8 is a direct-drive screw compressor according to one embodiment.

Turning now to FIG. 8 a further embodiment of a refrigerant system 100 is illustrated. The embodiment of FIG. 8 includes all of the features illustrated in the system 100 illustrated in FIG. 3. In FIG. 8, the fluid 120 is disposed within each of the plurality of bearing chambers 200 for providing lubrication to the plurality of bearing packs 190, thus providing pure refrigerant lubricated (PRL) bearings. A plurality of bearing lubrication ports generally referred to as 300 extend through the housing 130 and into each of the plurality of bearing chambers 200.

Figure 2:
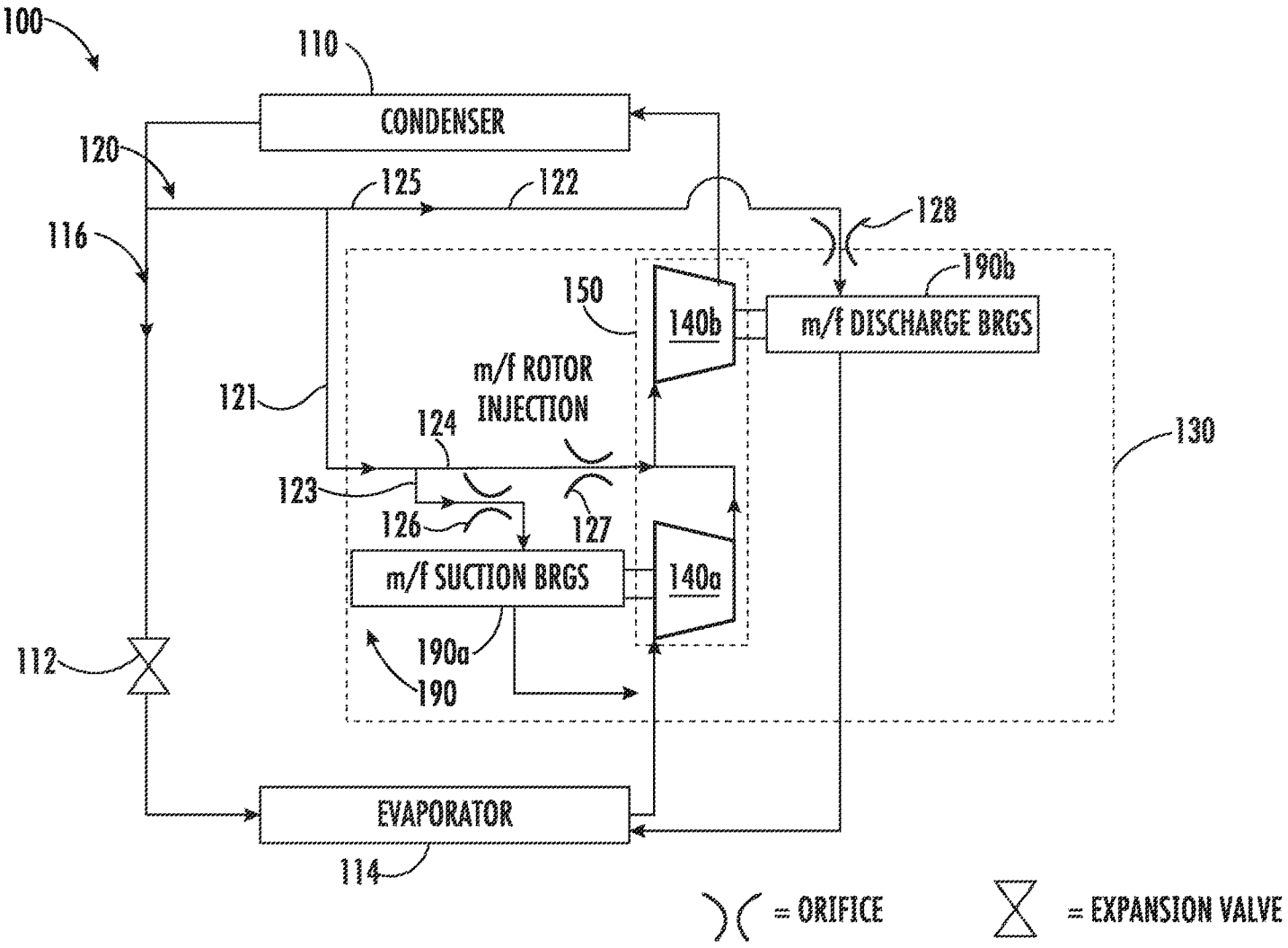
FIG. 2 is a refrigerant system according to a disclosed embodiment.

In addition, a suction side (upstream) lubrication port 300*a* includes a suction side (upstream) flow control orifice 301*a* (which may be the same as orifice 126 in FIG. 2). A discharge side (downstream) lubrication port 300*b* includes a discharge side (downstream) flow control orifice 301*b* (which may be the same as orifice 128 in FIG. 2).

The condenser conduit 125 fluidly connects the condenser 110 to the plurality of bearing lubrication ports 300. From this configuration, the plurality of bearing lubrication ports 300 are configured for injecting the fluid 120 into each of the plurality of bearing chambers 200 when the compressor 115 is running, to thereby provide lubrication to the plurality of bearing packs 190. In one embodiment the plurality of bearing lubrication ports 300 include a respective plurality flow control orifices 230 to reduce a flow volume or rate from the condenser 110 as may be needed.

In one embodiment, the condenser conduit 125 includes a forward branch 310*a* and an aft branch 310*b* for injecting in parallel the fluid 125 to each forward bearing chamber 200*a* and each aft bearing chamber 200*b* in the compressor. Each branch 310*a*, 310*b* includes a plurality of sub-branches generally referred to as 320 for injecting in parallel the fluid to the bearing chambers 200 on each branch 310*a*, 310*b*. This configuration enables the condenser 110 to feed the fluid 120 to the compressor 115 from the single condenser conduit 125.

As further illustrated in FIG. 8, for each rotor 150 the compressor 115 includes a lubricant drain port generally referred to as 360 fluidly connected to the evaporator by an evaporator conduit 370. The lubricant drain port 360 is for draining the fluid 120 from the plurality of bearing chambers 200 of the respective rotor 150 when the compressor 115 is running. In one embodiment, each lubricant drain port 360 extends into the respective aft bearing chamber 200*b* and is fluidly connected to the respective forward bearing chamber 200*a* through the respective aft bearing chamber 200*b*.

Figure 9:
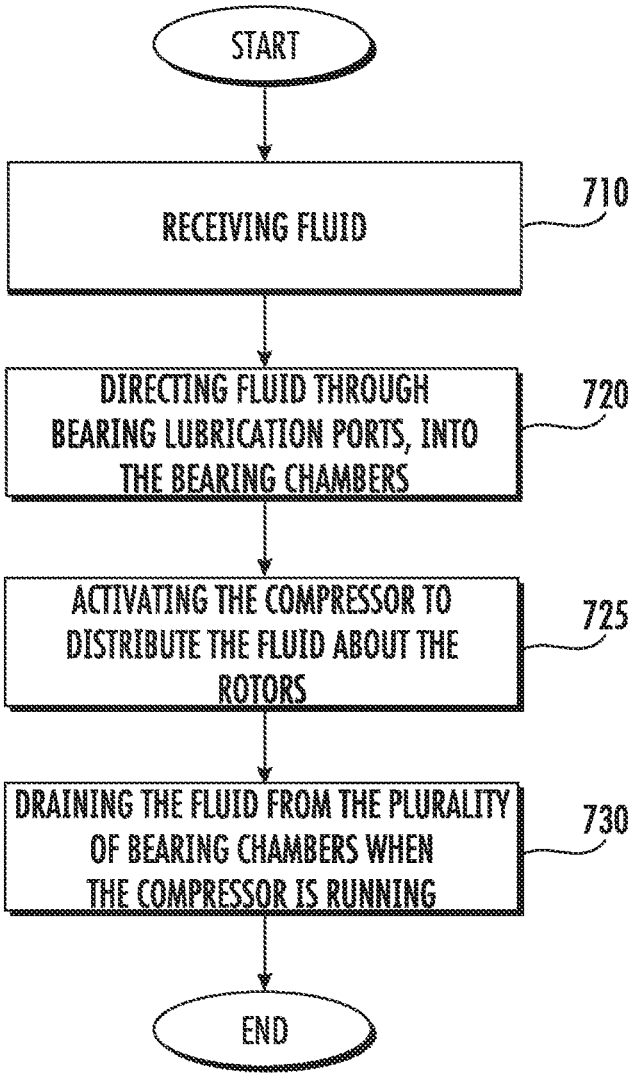
FIG. 9 is a method of transporting refrigerant as a lubricant with the compressor of FIG. 8.

As illustrated in FIG. 9, a further method is disclosed of directing fluid 120 in the compressor 115 in the refrigerant system 100. The method includes block 710 of receiving the fluid 120 from the compressor 115 in the refrigerant system 100, through a condenser conduit 125, at the plurality of bearing lubrication ports 300. The method includes block 720 of directing the fluid 120 through the plurality of bearing lubrication ports 300 to the plurality of bearing chambers 200. From this configuration the fluid 120 is injected, when the compressor 115 is running, to the plurality of bearing packs 190 in the respective plurality of bearing chambers 200. According to an embodiment, box 710 may further include controlling flow through the plurality of bearing lubrication ports 300 with a respective plurality of flow control orifices 230. Then, at block 725 the compressor is activated to distribute the fluid about the rotors 150. That is, the fluid 130 is inject to one side of the bearing packs 190 and is flow through the bearing packs 190 to lubricate each of the bearing packs 190.

According to an embodiment, for each rotor 150, the method includes block 730 of draining the fluid 120 through the lubricant drain port 360 from the plurality of bearing chambers 200 when the compressor 115 is running. According to an embodiment, for each rotor 150 block 730 further includes draining the fluid 120 from the plurality of chambers 20 through the aft bearing chamber 200, into the evaporator conduit 370, and to the evaporator 114 in the refrigerant system 100.

With the above disclosed embodiments, for example in FIGS. 3, 8 and 9, pure refrigerant lubricated (PRL) bearings are used in a screw compressor to support the loads on the rotors. The PRL bearings operate with a relatively low viscosity lubricant, such as liquid refrigerant as the working fluid. The liquid refrigerant as the working fluid is drawn from the chiller condenser and injected directly to each individual bearings or pack of bearings. The liquid flow can be adjusted by using flow restriction devices, such as an orifice.

With the above disclosed embodiments, oil separation equipment on a chiller is no longer necessary. This configuration reduces the complexity of the chiller system. The chiller cost will be therefore reduced. The chiller heat transfer efficiency will therefore increase.

Accordingly, as indicated above, there are two kinds of fluids in a typical system: oil and a working fluid. Oil is typically used for lubricating bearings and rotors and for sealing. The working fluid, such as refrigerant, is typically used to transmit heat. According to the disclosed embodiments, the working fluid, instead of oil, is used for lubricating bearings and rotors.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

We claim:

1. A direct-drive refrigerant screw compressor, comprising:

a housing;

a compression chamber in the housing;

a motor in the housing;

a pair of rotors disposed in the compression chamber, the pair of rotors including a first rotor and a second rotor, the second rotor having respective first and second axial shaft portions, the first axial shaft portion being driven by the motor, each rotor of the pair of rotors being rotationally disposed in the compression chamber and including an outer surface with a screw-geared profile to define alternating peaks and troughs axially along the outer surface;

a working fluid being disposed in the compression chamber for providing lubrication to each rotor, wherein the working fluid is refrigerant;

a first port extending through the housing and configured for directing the working fluid toward the compression chamber;

wherein:

for each rotor, the compressor includes a plurality of bearing packs disposed within a respective plurality of bearing chambers;

the first port is fluidly connected to a passage only in the second shaft portion and in the second rotor of the pair of rotors that directs the working fluid to the compression chamber;

the passage extends between an axial aft port of the second rotor passing through the second axial shaft portion and into the second rotor to end at the outer surface of the second rotor;

the axial aft port extends through one of the plurality of bearing chambers; and the passage includes an axial segment forming a blind hole and a plurality of radial segments that are axially spaced apart from each other and fluidly connected between the axial segment and a respective plurality of surface ports that are axially spaced apart from each other on the outer surface of the second rotor, and the passage includes a flow control orifice located aft of the plurality of radial segments, wherein the plurality of surface ports are axially spaced apart at regular intervals along the outer surface of only the second rotor of the pair of rotors, wherein at least one first surface port of the plurality of surface ports is positioned at or proximate a peak of the alternating peaks and troughs and at least one second surface port of the plurality of surface ports is disposed at or proximate a trough of the alternating peaks and troughs;

wherein the plurality of surface ports are configured to distribute the working fluid provided through the passage along the outer surface of the second rotor, so that when the motor operates to rotate the second rotor, the second rotor rotates the first rotor and disperses the distributed working fluid on the outer surface of the second rotor to provide the lubrication to the first rotor and the second rotor.

2. The compressor of claim 1, wherein:

the plurality of the radial segments each include opposing radial portions extending to respective surface ports of the plurality of the surface ports on the outer surface of the second rotor.

3. A refrigerant system including:

a condenser;

the compressor of claim 1; and a conduit fluidly connecting the condenser and the first port of the compressor, and configured to transport fluid to the first port of the compressor.

4. A method of directing fluid in a direct drive screw compressor, comprising:

receiving fluid at a first port of a housing of the compressor, wherein the fluid consists of a working fluid for providing lubrication to each rotor of a pair of rotors disposed in a compression chamber defined in the housing, the pair of rotors including a first rotor and a second rotor, each rotor including an outer surface with a screw-geared profile to define alternating peaks and troughs axially along the outer surface, wherein the working fluid is refrigerant, the second rotor having respective first and second axial shaft portions, the first axial shaft portion being driven by a motor disposed in the housing; and directing the working fluid from the first port through the second axial shaft portion and the second rotor to the compression chamber, wherein:

when the compressor is activated, each rotor rotates and the working fluid is distributed about each rotor to lubricate each rotor; and for each rotor, a plurality of bearing packs is disposed within a respective plurality of bearing chambers in the housing, and wherein the method further includes:

the directing the working fluid from the first port to the compression chamber further includes injecting the working fluid from the first port through a passage only formed in the second rotor of the pair of rotors so that working fluid is injected into the compression chamber from the second rotor;

the injecting the working fluid through the passage further includes directing the working fluid from the first port into an axial aft port of the passage and out a plurality of surface ports an outer surface of only the second rotor, wherein the axial aft port extends through one of the plurality of bearing chambers; and the directing the working fluid through the passage further includes directing the working fluid through an axial segment forming a blind hole in the second rotor and a plurality of radial segments that are axially spaced apart from each other and fluidly connected between the axial segment and the respective plurality of surface ports that are axially spaced apart from each other on the outer surface of the second rotor, to distribute the working fluid about the pair of rotors, wherein the plurality of surface ports are axially spaced apart at regular intervals along the outer surface of only the second rotor of the pair of rotors, the outer surface of the second rotor that includes the alternating peaks and troughs defined axially along the outer surface of the second rotor so that at least one first surface port of the plurality of surface ports is positioned at or proximate a peak of the alternating peaks and troughs and at least one second surface port of the plurality of surface ports is disposed at or proximate a trough of the alternating peaks and troughs; and controlling flow of the working fluid through the passage with a flow control orifice located in the passage at a position aft of the plurality of radial segments.

5. The method of claim 4, wherein:

the directing the working fluid through the passage further includes:

directing the working fluid through opposing radial portions of each of the plurality of the radial segments, the opposing radial portions extending to respective surface ports of the plurality of the surface ports on the outer surface of the second rotor.

6. The method of claim 4, comprising:

receiving the fluid at the first port from a condenser in a refrigerant system in which the compressor is integrated.

* * * * *